US008619070B2

(12) United States Patent
Lee et al.

(10) Patent No.: US 8,619,070 B2
(45) Date of Patent: Dec. 31, 2013

(54) GATE DRIVE CIRCUIT AND DISPLAY APPARATUS HAVING THE SAME

(75) Inventors: Hong-Woo Lee, Cheonan-si (KR); Eung-Gyu Lee, Cheonan-si (KR); Jong-Hwan Lee, Anyang-si (KR); Sung-Man Kim, Seoul (KR)

(73) Assignee: Samsung Display Co., Ltd. (KR)

( * ) Notice: Subject to any disclaimer, the term of this patent is extended or adjusted under 35 U.S.C. 154(b) by 549 days.

(21) Appl. No.: 12/970,787

(22) Filed: Dec. 16, 2010

(65) Prior Publication Data

US 2011/0199363 A1 Aug. 18, 2011

(30) Foreign Application Priority Data

Feb. 17, 2010 (KR) ..... 10-2010-0013974

(51) Int. Cl.
*G09G 5/00* (2006.01)

(52) U.S. Cl.
USPC ..... 345/212; 345/100; 345/89; 345/204; 327/108; 377/64; 377/79; 377/69; 377/78

(58) Field of Classification Search
USPC ..... 345/212, 100, 89, 87, 204; 327/108; 377/64, 79, 69, 78
See application file for complete search history.

(56) References Cited

U.S. PATENT DOCUMENTS

| | | | | |
|---|---|---|---|---|
| 2007/0018940 | A1* | 1/2007 | Park | 345/100 |
| 2007/0038909 | A1* | 2/2007 | Kim et al. | 714/726 |
| 2008/0012818 | A1* | 1/2008 | Lee et al. | 345/100 |
| 2008/0048712 | A1* | 2/2008 | Ahn et al. | 326/21 |

FOREIGN PATENT DOCUMENTS

| | | | |
|---|---|---|---|
| JP | 2004-157508 | A | 6/2004 |
| JP | 2004-212939 | A | 7/2004 |
| JP | 2005-025151 | A | 1/2005 |
| JP | 2007-140197 | A | 6/2007 |
| JP | 2007-317288 | A | 12/2007 |
| JP | 2009-092982 | A | 4/2009 |
| KR | 1020020069661 | A | 9/2002 |
| KR | 1020030095467 | A | 12/2003 |
| KR | 1020040061680 | A | 7/2004 |
| KR | 1020040111017 | A | 12/2004 |
| KR | 1020060078512 | A | 7/2006 |
| KR | 1020070002836 | A | 1/2007 |
| KR | 1020070037793 | A | 4/2007 |
| KR | 1020070057410 | A | 6/2007 |
| KR | 1020070113983 | A | 11/2007 |
| KR | 1020090073966 | A | 7/2009 |
| KR | 1020090109257 | A | 10/2009 |

* cited by examiner

*Primary Examiner* — Lun-Yi Yao
*Assistant Examiner* — Shaheda Abdin
(74) *Attorney, Agent, or Firm* — Innovation Counsel LLP

(57) ABSTRACT

An n-th stage (wherein, n is an integer) of the stages of a gate driving circuit includes a pull-up part, a first variable mode part and a second variable mode part. At least one of the first and second variable mode parts includes a variable element. The variable element comprises a first thin-film transistor (TFT) turned on in response to a first level voltage of the first or second direction signal, a second TFT applying the first or second direction signal to a control part of the pull-up part in response to an output signal of a previous stage or an output signal of a next stage, and a third TFT connected to the second TFT through the first TFT.

18 Claims, 8 Drawing Sheets

GATE DRIVE CIRCUIT AND DISPLAY APPARATUS HAVING THE SAME

PRIORITY STATEMENT

This application claims priority under 35 U.S.C. §119 to Korean Patent Application No. 2010-13974, filed on Feb. 17, 2010 in the Korean Intellectual Property Office (KIPO), the contents of which are herein incorporated by reference in their entirety.

BACKGROUND OF THE INVENTION

1. Field of the Invention

Embodiments of the present invention relate generally to flat panel displays. More particularly, embodiments of the present invention relate to a gate driving circuit for bi-directional driving and a display apparatus having the gate driving circuit.

2. Description of the Related Art

It is often desirable to decrease both the manufacturing cost and the total size of panel modules in display devices. One technology used to accomplish this is amorphous silicon gate (ASG) technology, in which a gate driving circuit is formed in a peripheral area of the panel and a switching device is disposed in a display area of the panel. The gate driving circuit sequentially outputs a plurality of gate signals from the peripheral area, delivering them to the switching devices in the display area.

In one relatively recently-developed operation mode, panels display a forward image or a reverse image that is rotated to an angle of 180° with respect to the forward image. In this mode, display of the reverse image involves an output sequence of the gate driving circuit that is fixed, while an output sequence of the image data is reversed.

SUMMARY OF THE INVENTION

Example embodiments of the present invention provide a gate driving circuit capable of a bi-directional driving.

Example embodiments of the present invention also provide a display apparatus including the gate driving circuit.

According to one aspect of the present invention, a gate driving circuit includes a plurality of stages cascade-connected to each other. Each of the plurality of stages outputs a respective one of a plurality of gate signals. An n-th stage (wherein, n is an integer) of the stages includes a pull-up part, a first variable mode part and a second variable mode part. The pull-up part outputs a first voltage of a first clock signal as an output signal of the n-th stage in response to an input voltage. The first variable mode part applies a first direction signal to a control part of the pull-up part in response to an output signal of a previous one of the stages. The second variable mode part applies a second direction signal to the control part of the pull-up part in response to an output signal of a next one of the stages, the second direction signal being different from the first direction signal. At least one of the first and second variable mode parts includes a variable element that comprises first, second, and third thin film transistors (TFTs). The first TFT is turned on in response to a first level voltage of the first or second direction signal. The second thin-film transistor (TFT) applies the first or second direction signal to the control part of the pull-up part in response to the output signal of a previous one of the stages or the output signal of a next one of the stages. The third TFT is connected to the second TFT through the first TFT, and applies the first or second direction signal to the control part of the pull-up part in response to the output signal of a previous one of the stages or the output signal of a next one of the stages. When the first direction signal is applied to the first variable mode part, the second direction signal is applied to the second variable mode part, the first direction signal has the first level voltage, and the second direction signal has a second level voltage that is lower than the first level voltage, the n stages are driven in a first direction. Conversely, when the second direction signal is applied to the first variable mode part, the first direction signal is applied to the second variable mode part, the first direction signal has the first level voltage, and the second direction signal has the second level voltage, the n stages are driven in a second direction opposite to the first direction.

According to another aspect of the present invention, a display apparatus includes a display panel, a gate driving circuit and a main driving circuit. The display panel includes a display area and a peripheral area surrounding the display area, where the display area is for displaying an image. The display panel also includes gate and source lines formed at least partially in the display area. The gate driving circuit is integrated in the peripheral area and including a plurality of stages outputting gate signals to their respective gate lines. The main driving circuit provides a first direction signal and a second direction signal to the gate driving circuit according to a direction of an image to be displayed on the display panel, where the second direction signal is different from the first direction signal. An n-th stage (wherein n is an integer) of the stages includes a pull-up part outputting a first voltage of a first clock signal as an output signal of the n-th stage in response to an input voltage; a first variable mode part applying a first direction signal to a control part of the pull-up part in response to an output signal of a previous one of the stages and a second variable mode part applying a second direction signal to the control part of the pull-up part in response to an output signal of a next one of the stages. At least one of the first and second variable mode parts includes a variable element, the variable element comprising first, second, and third thin film transistors (TFTs). The first TFT is turned on in response to a first level voltage of the first or second direction signal. The second TFT applies the first or second direction signal to the control part of the pull-up part in response to the output signal of a previous one of the stages or the output signal of a next one of the stages. The third TFT is connected to the second TFT through the first thin film transistor, and applies the first or second direction signal to the control part of the pull-up part in response to in response to the output signal of a previous one of the stages or the output signal of a next one of the stages. When the first direction signal is applied to the first variable mode part, the second direction signal is applied to the second variable mode part, the first direction signal has the first level voltage, and the second direction signal has a second level voltage that is lower than the first level voltage, the n stages are driven in a first direction. Conversely, when the second direction signal is applied to the first variable mode part, the first direction signal is applied to the second variable mode part, the first direction signal has the first level voltage, and the second direction signal has the second level voltage, the n stages are driven in a second direction opposite to the first direction.

According to the gate driving circuit and display apparatus of embodiments of the invention, the operation mode of the first and second variable mode parts is changed by the level of the first and second direction signals, so that the gate driving circuit may be driven in the forward direction or the reverse direction as desired.

BRIEF DESCRIPTION OF THE DRAWINGS

The above and other features and advantages of the present invention will become more apparent by describing in detailed example embodiments thereof with reference to the accompanying drawings, in which.

DETAILED DESCRIPTION OF THE INVENTION

Figure 1:
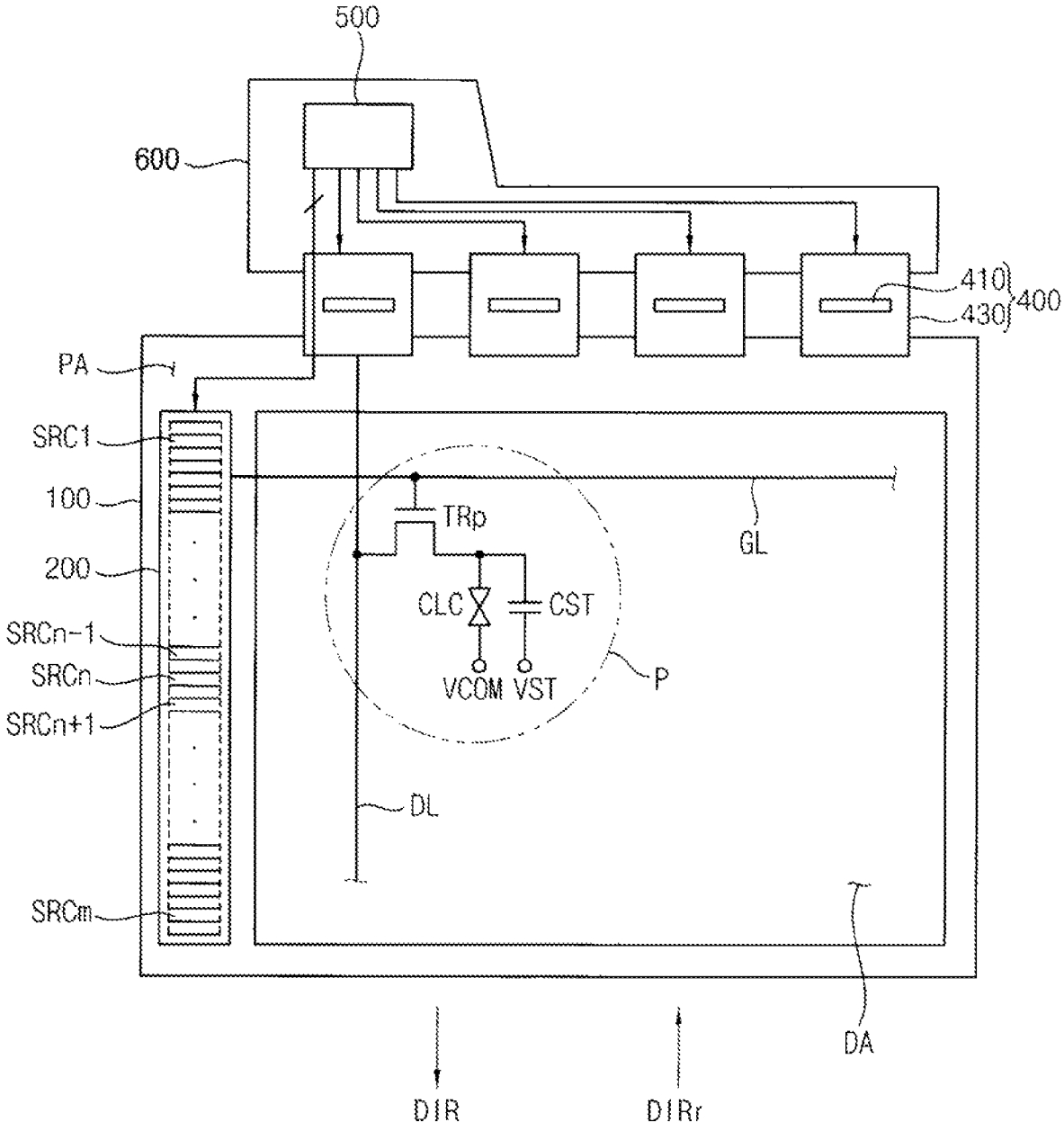
FIG. 1 is a plan view illustrating a display apparatus according to an example embodiment of the present invention.

The present invention is described more fully hereinafter with reference to the accompanying drawings, in which example embodiments of the present invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the invention are described herein with reference to cross-sectional illustrations that are schematic illustrations of idealized example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

FIG. 1 is a plan view illustrating a display apparatus according to an example embodiment of the present invention.

Referring to FIG. 1, the display apparatus includes a display panel 100, a gate driving circuit 200, a data driving circuit 400, a main driving circuit 500 and a printed circuit board (PCB) 600.

The display panel 100 includes a display area DA and a peripheral area PA surrounding the display area DA. A plurality of gate lines GL, a plurality of source lines DL, also known as data lines, and a plurality of pixel parts P are formed in the display area DA. Each pixel part P includes a pixel switching element TRp electrically connected to a gate line GL and a source line DL, a liquid crystal capacitor CLC electrically connected to the pixel switching element TRp, and a storage capacitor CST connected in parallel with the liquid crystal capacitor CLC. A common voltage VCOM is applied to a common electrode of the liquid crystal capacitor CLC, and a storage common voltage VST is applied to a common electrode of the storage capacitor CST.

The gate driving circuit 200 includes a shift register sequentially outputting gate signals to the gate lines GL. The shift register includes a plurality of stages SRC1, . . . , SRCn−1, SRCn, SRCn+1, . . . , SRCm (wherein, n and m are integers and n<m). For example, the gate driving circuit 200 is integrated in the peripheral area PA at one end of the gate lines GL. That is, the gate driving circuit 200 can be formed via a process substantially same as that used to form the pixel switching element TRp.

The source driving circuit 400 includes a source driving chip 410 outputting data signals to the source lines DL, as well as a flexible printed circuit board (FPCB) 430. The source driving chip 410 is mounted on the FPCB 430, and the FPCB 430 electrically connects the display panel 100 with the PCB 600. Here, the source driving chip 410 is mounted on the FPCB 430 as illustrated in FIG. 1. Alternatively, the source driving chip 410 may be directly mounted on the display panel 100, or the source driving chip 410 may be formed via a process substantially same as that for forming the pixel switching element TRp. The main driving circuit 500 is mounted on the PCB 600 and provides a gate control signal and a data control signal to the gate driving circuit 200 and the data driving circuit 400, respectively.

For example, the gate control signal includes a vertical start signal STV, a first clock signal CK1, a second clock signal CK2, a gate off signal VSS, a first direction signal VD1 and a second direction signal VD2.

When the gate driving circuit 200 receives a first direction signal VD1 having a first level voltage VON ("high voltage") and a second direction signal VD2 having a second level voltage VSS ("low voltage"), the stages SRC1, . . . , SRCn−1, SRCn, SRCn+1, . . . , SRCm are sequentially driven in a forward direction DIR so as to sequentially output first to m-th gate signals G1, . . . , Gn−1, Gn, Gn+1, . . . , Gm. Conversely, when the gate driving circuit 200 receives the first direction signal VD1 having the low voltage VSS and the second direction signal VD2 having the high voltage VON, the stages SRC1, . . . , SRCn−1, SRCn, SRCn+1, . . . , SRCm are sequentially driven in a reverse direction DIRr so as to sequentially output the m-th to the first gate signals Gm, . . . , Gn+1, Gn, Gn−1, . . . , G1.

Figure 2:
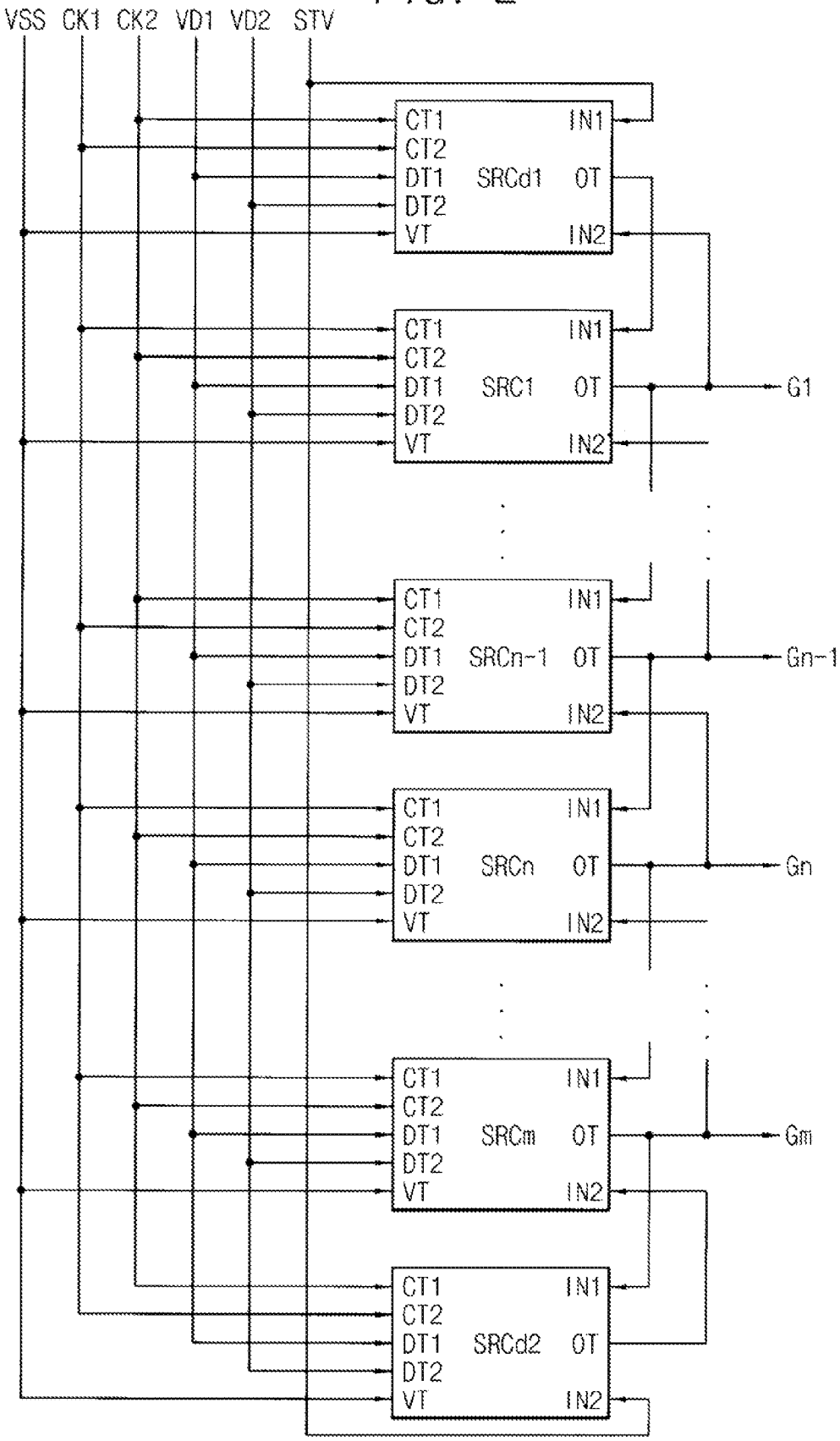
FIG. 2 is a block diagram illustrating a gate driving circuit of FIG. 1.

FIG. 2 is a block diagram illustrating a gate driving circuit of FIG. 1.

Referring to FIG. 1 and FIG. 2, the gate driving circuit 200 includes a shift register that includes a first stage SRC1 to an m-th stage SRCm cascade-connected to each other, a first dummy stage SRCd1 and a second dummy stage SRCd2.

The first to the m-th stages SRC1 to SRCm are connected to m gate lines, and sequentially output m gate signals to the respective m gate lines. The first dummy stage SRCd1 controls the driving of the first stage SRC1, and the second dummy stage SRCd2 controls the driving of the m-th stage SRCm. The first dummy stage SRCd1 and the second dummy stage SRCd2 are not connected to gate lines.

Each stage includes a first clock terminal CT1, a second clock terminal CT2, a first direction terminal DT1, a second direction terminal DT2, a voltage terminal VT, an output terminal OT, a first input terminal IN1 and a second input terminal IN2.

The first clock terminal CT1 receives a first clock signal CK1 or a second clock signal CK2 having a phase different from that of the first clock signal CK.

For example, the first clock terminal CT1 of each odd-numbered stage SRCd1, . . . , SRCn−1, . . . , SRCd2 receives the second clock signal CK2, and the first clock terminal CT1 of each even-numbered stage SRC1, . . . , SRCn, . . . , SRCm receives the first clock signal CK1. Each of the first and second clock signals CK1 and CK2 has a pulse corresponding to the high voltage VON and the voltage VSS, and a duty ratio of the pulse may be about 50% or lower.

The second clock terminal CT2 receives a clock signal different from the clock signal applied to the first clock terminal CT1. For example, as shown in FIG. 2, the second clock terminal CT2 of the odd-numbered stages SRCd1, . . . , SRCn−1, . . . , SRCd2 receives the first clock signal CK1, and the second clock terminal CT2 of even-numbered stages SRC1, . . . , SRCn, . . . , SRCm receives the second clock signal CK2.

The first direction terminal DT1 receives a first direction signal VD1 and the second direction terminal DT2 receives a second direction signal VD2. The signals VD1 and VD2 govern the direction in which the gate driving circuit 200 is to be driven. For example, when the gate driving circuit 200 is driven in the forward direction DIR, the first direction signal VD1 is the high voltage VON and the second direction signal VD2 is the low voltage VSS. However, when the gate driving circuit 200 is driven in the reverse direction DIRr, the first direction signal VD1 is the low voltage VSS and the second direction signal VD2 is the high voltage VON.

The output terminal OT is connected to the gate line and outputs an output signal. The output signal of each stage SRC1-SRCm is applied to the respective gate line.

The voltage terminal VT receives the low voltage VSS. The low voltage VSS is a low level of the gate signal that is outputted to the output terminal OT.

The first input terminal IN1 receives a vertical start signal STV or an output signal of one of previous stages. The output signal is the gate signal having the high voltage outputted from the output terminal OT of one of the previous stages. For example, the first input terminal IN1 of the first stage that is the first dummy stage SRCd1 receives the vertical start signal STV and the first input terminal IN1 of each of stages SRC1, . . . , SRCn−1, SRCn, . . . , SRCm, SRCd2 receives the output signal from each of the previous stages. That is, the output of the first to (n−1)-th stages SRC1, . . . , SRCn−1 factors into the output of the n-th stage SRCn.

The second input terminal IN2 receives the output signal of the following stages, or the vertical start signal STV. The second input terminal IN2 of each of the first dummy stage to the m-th stage SRCd1, SRC1, . . . , SRCn−1, SRCn, . . . , SRCm receives an output signal outputted from the following stage. The output signal is the gate signal from the output terminal OT of the following stage. The second input terminal IN2 of the second dummy stage SRCd2 receives the vertical start signal STV.

Figure 3:
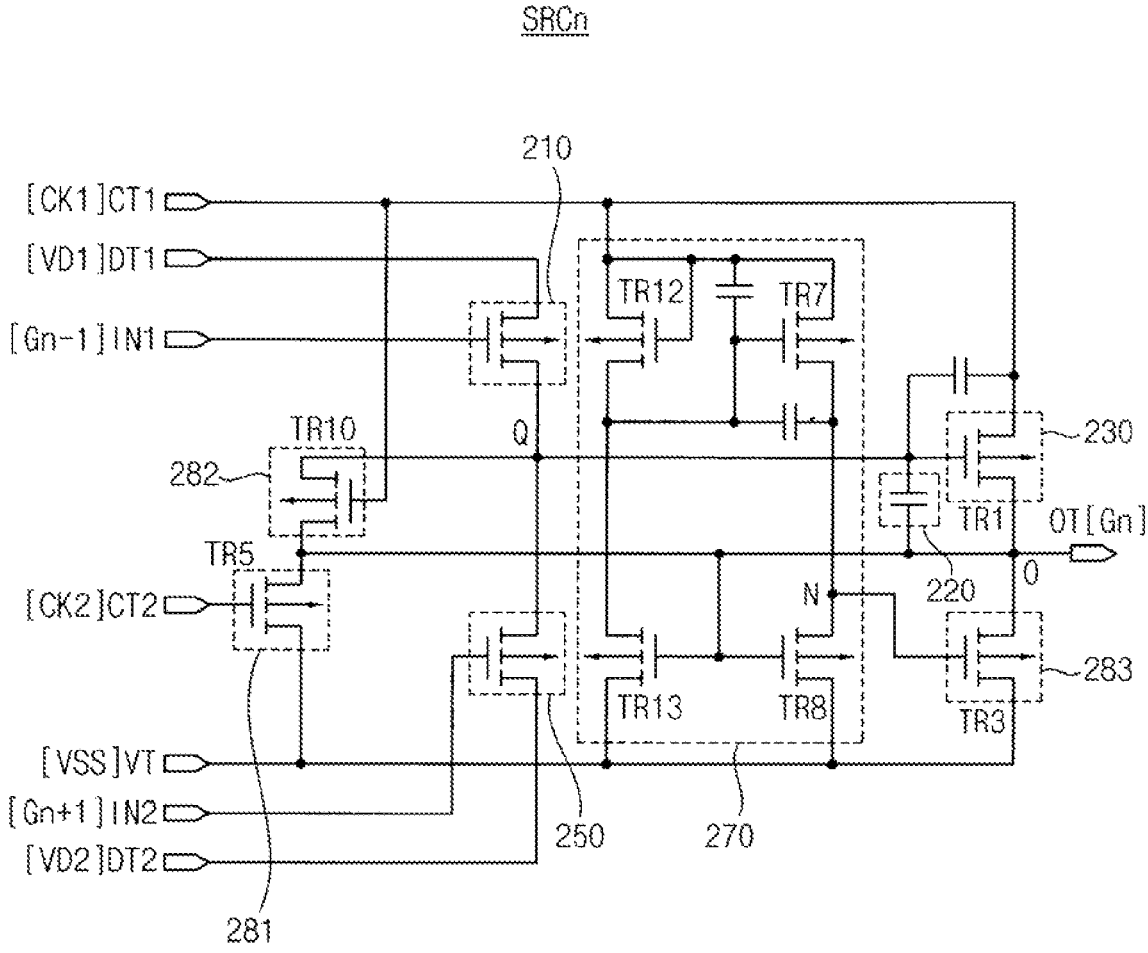
FIG. 3 is a circuit diagram illustrating an n-th stage of FIG. 2.

FIG. 3 is a circuit diagram illustrating the n-th stage of FIG. 2.

Referring to FIG. 2 and FIG. 3, the n-th stage SRCn includes a first variable mode part 210, a charging part 220, a pull-up part 230, a second variable mode part 250, a switching part 270, a first holding part 281, a second holding part 282 and a third holding part 283.

The first variable mode part 210 is driven in a charging mode in which the high voltage VON is applied to a node Q and in a discharging mode in which the low voltage VSS is applied to the node Q. The first variable mode part 210 includes a control part, a first electrode part and a second electrode part. The control part is connected to the first input terminal IN1 and receives the (n−1)-th gate signal Gn−1, which is the output signal of the (n−1)-th stage SRCn−1. The first electrode part is connected to first direction terminal DT1, which receives the first direction signal VD1. The second electrode part is connected to the node Q. The node Q is connected to a first end of the charging part 220.

When the high voltage VON is applied to VD1, the first variable mode part 210 is driven in the charging mode so the high voltage VON of the first direction signal VD1 is applied to the node Q. The charging part 220 is charged by the high voltage.

Conversely, when low voltage VSS is applied to VD1, the first variable mode part 210 is driven in the discharging mode so that the charging part 220 is discharged to the low voltage VSS. Thus, the first variable mode part 210 is selectively driven in either the charging mode or the discharging mode, according to a level of the first direction signal VD1.

The pull-up part 230 includes a first transistor TR1. The first transistor TR1 includes a control part connected to the node Q, an input part connected to the first clock terminal CT1 and an output part connected to the output terminal OT. The control part of the pull-up part 230 is connected to the first end of the charging part 220 and the output part of the pull-up part 230 is connected to an output node O. The charging part 220 is a capacitor that includes a first end connected to the node Q and a second end connected to the output node O.

When the first clock terminal CT1 receives the high voltage VON of the first clock signal CK1 and the control part of the pull-up part 230 receives a charging voltage VC from the charging part 220, the pull-up part 230 is bootstrapped, i.e. the voltage at the node Q is raised to a boosting voltage VBT. When the boosting voltage VBT is applied to the control part of the pull-up part 230, the pull-up part 230 outputs the high voltage VON of the first clock signal CK1 as the n-th gate signal Gn.

When the low voltage VSS is applied to the node Q, the second variable mode part 250 is driven in a discharging mode. Conversely, when the high voltage VON is applied to the node Q, the second variable mode part 250 is driven in a charging mode. The second variable mode part 250 includes a control part connected to the second input terminal IN2, a first electrode part connected to the node Q, and a second electrode part connected to the second direction terminal DT2.

When the second input terminal IN2 receives the high voltage VON of the (n+1)-th gate signal Gn+1 and the second electrode part DT2 receives the low voltage VSS, the second variable mode part 250 is driven in its discharging mode. In the discharging mode, a voltage applied to the node Q is discharged to the low voltage VSS.

However, when the second input terminal IN2 receives the high voltage VON of the (n+1)-th gate signal Gn+1 and the second electrode part DT2 receives the high voltage VON, the second variable mode part 250 is driven in its charging mode. In this mode, the high voltage VON of the second direction signal VD2 is applied to the node Q, charging the charging part 220. Thus, the second variable mode part 250 is selectively driven in the charging mode or in the discharging mode according to the level of the second direction signal VD2.

The switching part 270 includes a twelfth transistor TR12, a seventh transistor TR7, a thirteenth TR13 and an eighth transistor TR8. A control part and an input part of the twelfth transistor TR12 are connected to the first clock terminal CT1, and an output part of the twelfth transistor TR12 is connected to an input part of the thirteenth transistor TR13 and a control part of the seventh transistor TR7. An input part of the seventh transistor TR7 is connected to the first clock terminal CT1, and an output part of the seventh transistor TR7 is connected to the input part of the eighth transistor TR8. An output part of the seventh transistor TR7 is connected to a node N. The switching part 270 controls a voltage applied to the node N.

The switching part 270 applies a signal to the node N that is synchronized with the first clock signal CK1. When the high voltage VON is applied to the output node O, the eighth transistor TR8 and the thirteenth transistor TR13 are turned on, so that a voltage applied to the node N is discharged to the low voltage VSS.

The first holding part 281 includes a fifth transistor TR5. The fifth transistor TR5 includes a control part connected to the second clock terminal CT2, an input part connected to the output node O, and an output part connected to the voltage terminal VT. When the second clock terminal CT2 receives the high voltage of the second clock signal CK2, the first holding part 281 discharges a voltage applied to the output node O to the low voltage VSS applied to the voltage terminal VT.

The second holding part 282 includes a tenth transistor TR10. The tenth transistor TR10 includes a control part connected to the first clock terminal CT1, an input part connected to the node Q and an output part connected to the output node O. When the first clock signal CK1 is applied to the first clock terminal CT1, the transistor TR10 is turned on, holding the voltage at the node Q at the level of the voltage applied to node O, i.e. low voltage VSS. The first clock signal CK1 is applied to the first clock terminal CT1 during times outside the n-th period of the frame. The n-th period is a period in which the n-th stage SRCn outputs the n-th gate signal of the high voltage Von.

The third holding part 283 includes a third transistor TR3. The third transistor TR3 includes a control part connected to the node N, an input part connected to the output node O, and an output part connected to the voltage terminal VT. When the high voltage VON is applied to the node N, the third holding part 283 discharges a voltage applied to the output node O to the low voltage VSS that is applied to the voltage terminal VT.

Figure 4:
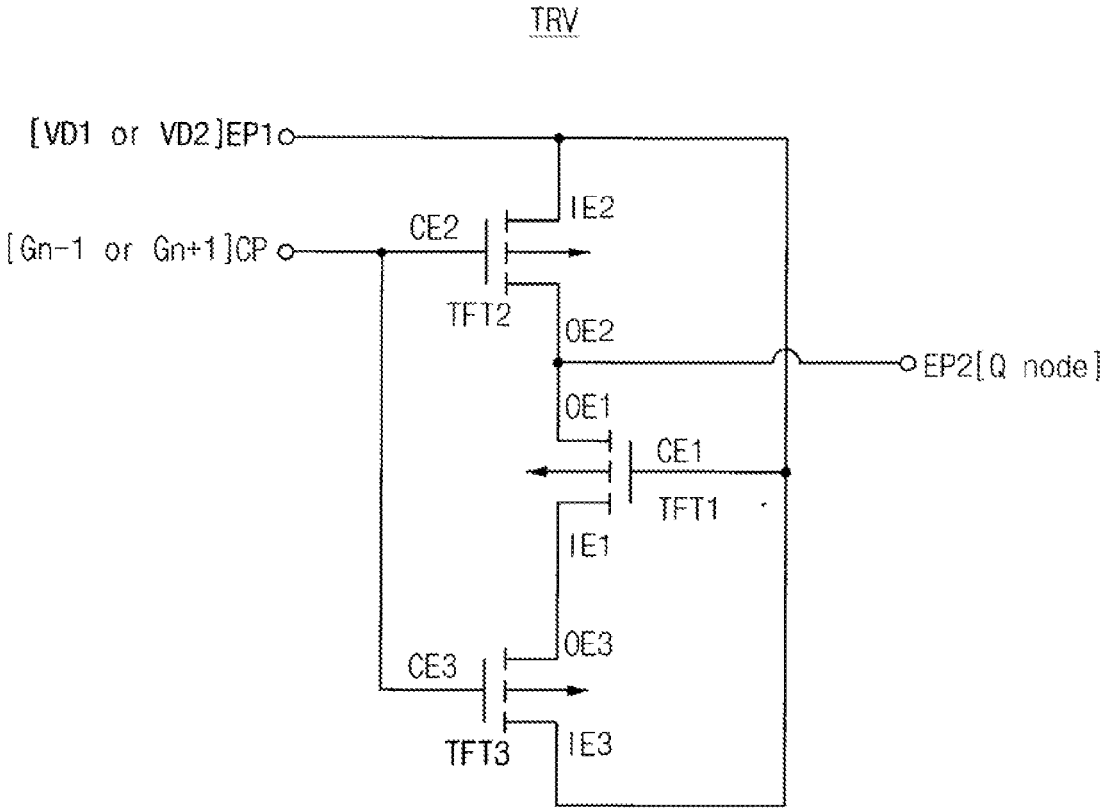
FIG. 4 is a circuit diagram illustrating a first variable mode part or a second variable mode part of FIG. 3.
Figure 5:
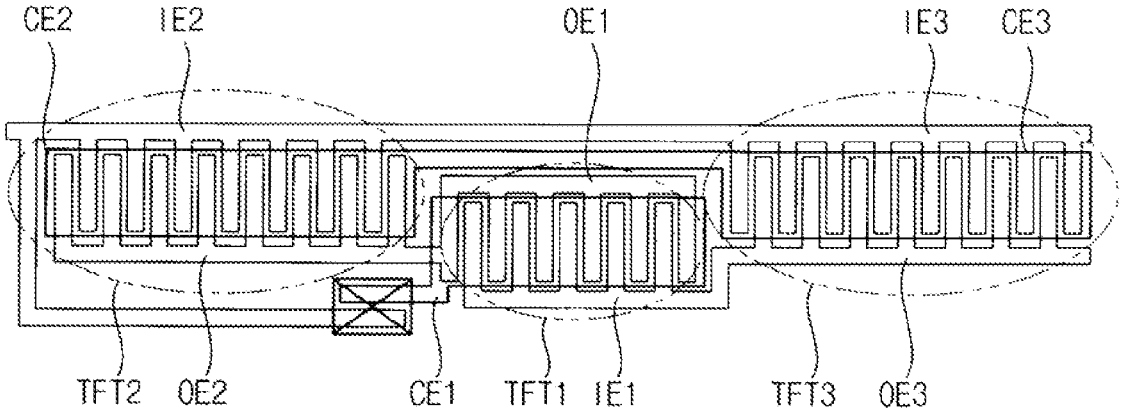
FIG. 5 is a plan view illustrating the first variable mode part or the second variable mode part of FIG. 4.

FIG. 4 is a circuit diagram illustrating a first variable mode part or a second variable mode part of FIG. 3. FIG. 5 is a plan view illustrating the first variable mode part or the second variable mode part of FIG. 4.

Referring to FIG. 4 and FIG. 5, at least one of the first variable mode part 210 and the second variable mode part 250 includes a variable element TRV. The variable element TRV includes a first thin film transistor (TFT) TFT1, a second TFT TFT2 and a third TFT TFT3. The first TFT TFT1 is turned on in response to the high voltage VON of the first or second direction signal VD1 or VD2. The second TFT TFT2 applies the first or second direction signal VD1 or VD2 to the control part (node Q) of the pull-up part 230 in response to the (n−1)-th or (n+1)-th gate signal Gn−1 or Gn+1. The third TFT TFT3 is connected to the second TFT TFT2 through the first TFT TFT1, and applies the first or second direction signal VD1 or VD2 to the control part (node Q) of the pull-up part 230 in response to the (n−1)-th or (n+1)-th gate signal Gn−1 or Gn+1. For example, the variable element TRV includes a control part CP receiving the (n−1)-th or (n+1)-th gate signal Gn−1 or Gn+1, a first electrode part EP1 receiving the first or second direction signal VD1 or VD2 and a second electrode part EP2 connected to the control part (node Q) of the pull-up part 230.

The first TFT TFT1 includes a first control electrode CE1, a first input electrode IE1 and a first output electrode OE1.

The first control electrode CE1 is connected to the first electrode part EP1, the first input electrode IE1 is connected to the third TFT TFT3, and the first output electrode OE1 is connected to the second TFT TFT2.

The second TFT TFT2 includes a second control electrode CE2, a second input electrode IE2 and a second output electrode OE2. The second control electrode CE2 is connected to the control part CP, the second input electrode IE2 is connected to the first electrode part EP1, and the second output electrode OE2 is connected to the second electrode part EP2.

The third TFT TFT3 includes a third control electrode CE3, a third input electrode IE3 and a third output electrode OE3. The third control electrode CE3 is connected to the control part CP, the third input electrode IE3 is connected to the first electrode part EP1, and the third output electrode OE3 is connected to the first TFT TFT1.

Each of the first, second and third input electrodes IE1, IE2 and IE3 has a number of U shapes formed by protruding fingerlike structures. Each of the first, second and third output electrodes OE1, OE2 and OE3 has a number of corresponding U shapes. Each of the first, second and third output electrodes OE1, OE2 and OE3 is positioned in an interlocking manner with each of the first, second and third input electrodes IE1, IE2 and IE3 and is spaced apart from each of the first, second and third input electrodes IE1, IE2 and IE3, so that the fingerlike structures of each of the input electrodes extends into the U shapes of the output electrodes, and vice versa.

For example, when the control part CP receives the high voltage VON and the first electrode part EP1 receives the low voltage VSS, the variable element TRV is driven in the discharging mode. The first TFT TFT1 is turned off and the second and third TFTs TFT2 and TFT3 are turned on. The first TFT TFT1 is turned off so that the third TFT TFT3 does not operate. In the discharging mode, the variable element TRV is driven by only the second TFT TFT2, so that a first current is applied to the node Q. In the discharging mode, a channel length-to-channel width ratio of the variable element TRV is substantially the same as that of the second TFT TFT2.

However, when the control part CP receives the high voltage VON and the first electrode part EP1 receives the high voltage VON, the variable element TRV is driven in the charging mode. The first, second and third TFTs TFT1, TFT2 and TFT3 are each turned on. A current flowing through the second TFT TFT2 and a current flowing through the third TFT TFT3 are both applied to the second electrode part EP2. In the charging mode, the variable element TRV is driven by the second and third TFTs TFT2 and TFT3, so that a current two times larger than the first current in the discharging mode is applied to the node Q. In the charging mode, it can be seen that the channel length-to-channel width ratio of the variable element TRV is about two times larger than that of the second TFT TFT2. The channel length-to-channel width ratio of the variable element TRV is selectively adjusted according to the charging mode and the discharging mode, so that operation quality of the variable element TRV may be improved.

According to the present example embodiment, the first and second variable mode parts 210 and 250 may be selectively adjusted according to the charging mode and the discharging mode, as above.

Figure 6A:
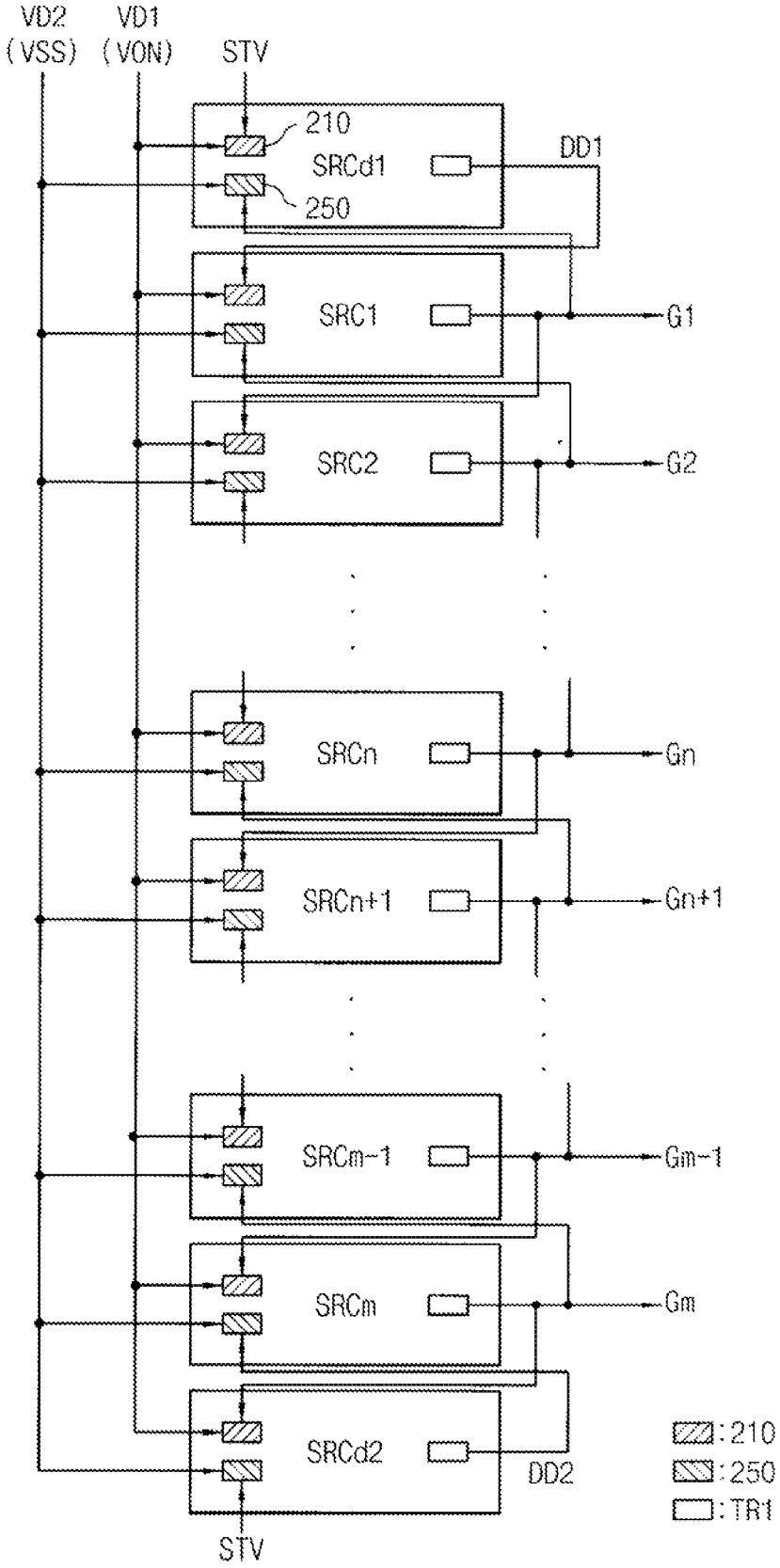
FIG. 6A is a block diagram illustrating an operation in which the gate driving circuit of FIG. 2 is driven in a forward direction.
Figure 6B:
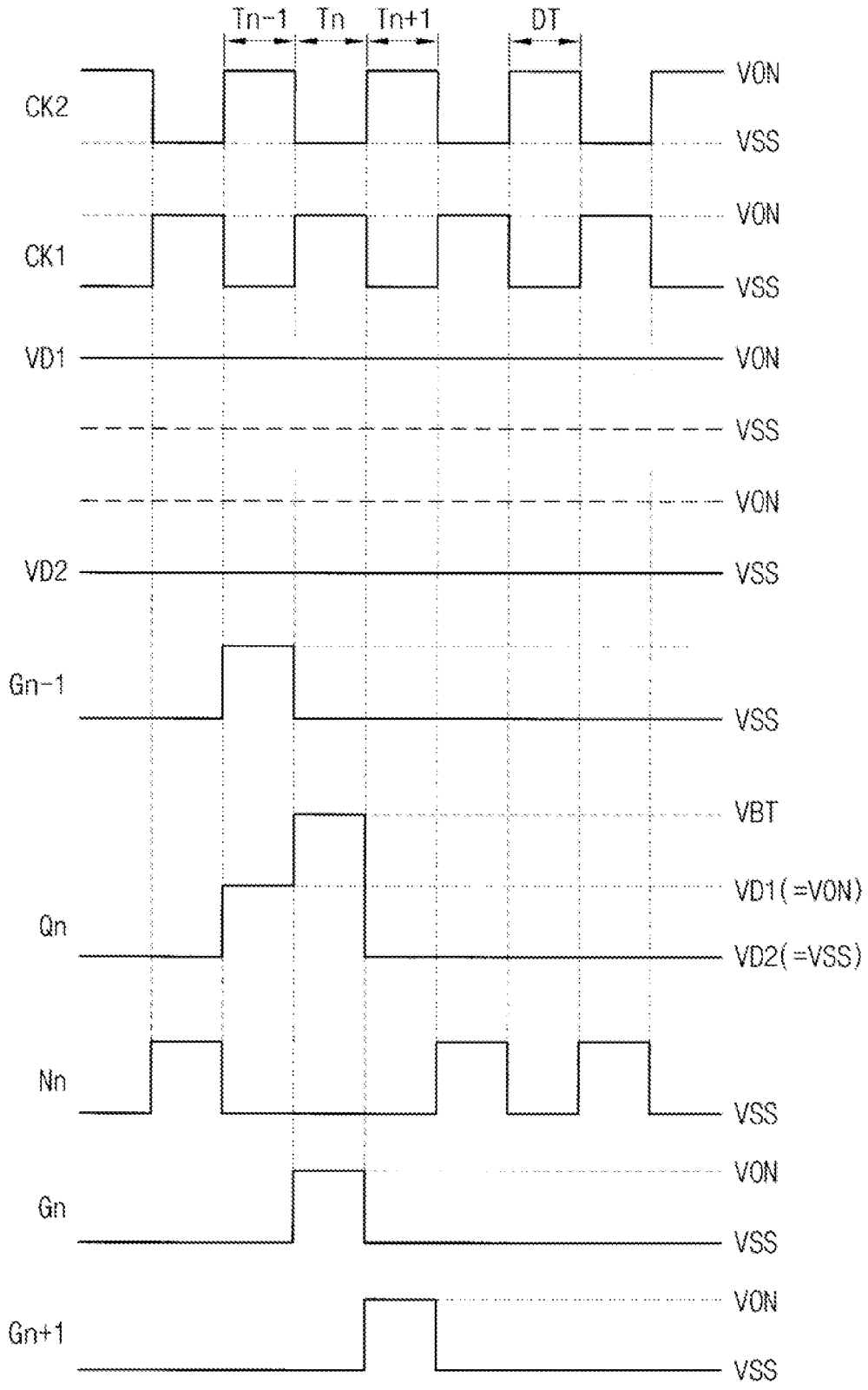
FIG. 6B is a waveform diagram illustrating input/output signals of the n-th stage of FIG. 6A.

FIG. 6A is a block diagram illustrating an operation in which the gate driving circuit of FIG. 2 is driven in a forward direction. FIG. 6B is a waveform diagram illustrating input/output signals of the n-th stage of FIG. 6A.

Referring to FIG. 4 and FIG. 6A, the gate driving circuit 200 receives the vertical start signal STV, the first clock signal CK1, the second clock signal CK2, the first direction signal VD1 (VON), the second direction signal VD2 (VSS) and the low voltage VSS. The first and second clock signals CK1 and CK2 are different from each other, and have a duty ratio DT of about 50% or lower.

The vertical start signal STV is applied to the first stage, that is, the first dummy stage SRCd1 and a last stage, that is, the second dummy stage SRCd2. The first clock signal CK1, the second clock signal CK2, the first direction signal VD1 (VON), the second direction signal VD2 (VSS) and the low voltage VSS are applied to all stages of the gate driving circuit 200. The first variable mode part 210 of each of the stages is driven in the charging mode by receiving the high voltage VON. The second variable mode part 250 of each of the stages is driven in the discharging mode by receiving the low voltage VSS.

When the first variable mode part 210 of the first dummy stage SRCd1 receives the vertical start signal STV, the first dummy stage SRCd1 is driven so as to output a first dummy signal DD1 having the high voltage VON through the first transistor TR1. The first dummy signal DD1 is applied to the first variable mode part 210 of the first stage SRC1. The first dummy signal DD1 is not applied to the gate line, and is used as a start signal of the first stage SRC1.

When the first variable mode part 210 of a first stage SRC1 receives the high voltage VON of the first dummy signal DD1, the first stage SRC1 is driven so as to output a first gate signal G1, with high voltage VON, through its first transistor TR1. When the first gate signal G1 having the high voltage VON is applied to the second variable mode part 250 of the first dummy stage SRCd1, the first dummy stage SRCd1 outputs the first dummy signal DD1 at low voltage VSS.

When the first variable mode part 210 of a second stage SRC2 receives the high voltage VON of the first gate signal G1, the second stage SRC2 is driven so as to output a second gate signal G2, at high voltage VON, through the first transistor TR1. When the second gate signal G2 at high voltage VON is applied to the second variable mode part 250 of the first stage SRC1, the first stage SRC1 outputs the first gate signal G1 at low voltage VSS. When the high voltage VON of a third gate signal G3 is applied to the second variable mode part 250 of the second stage SRC2, the second stage SRC2 outputs the second gate signal G2 at low voltage VSS.

When the first variable mode part 210 of an n-th stage SRCn receives the high voltage VON of an (n−1)-th gate signal Gn−1, the n-th stage SRCn is driven so as to output the n-th gate signal Gn at high voltage VON.

When the first variable mode part 210 of an (n+1)-th stage SRCn+1 receives the high voltage VON of the n-th gate signal Gn, the (n+1)-th stage SRCn+1 is driven so as to output the (n+1)-th gate signal Gn+1 at high voltage VON. When VON is applied to the second variable mode part 250 of the n-th stage SRCn, the n-th stage SRCn outputs the n-th gate signal Gn at low voltage VSS.

When the first variable mode part 210 of an (m−1)-th stage SRCm−1 receives the high voltage VON of an (m−2)-th gate signal Gm−2, the (m−1)-th stage SRCm−1 is driven so as to output the (m−1)-th gate signal Gm−1 at high voltage VON.

When the first variable mode part 210 of an m-th stage SRCm receives the high voltage VON of the (m−1)-th gate signal G−1, the m-th stage SRCm is driven so as to output the m-th gate signal Gm at high voltage VON. When VON is applied to the second variable mode part 250 of the (m−1)-th stage SRCm−1, the (m−1)-th stage SRCm−1 outputs the (m−1)-th gate signal Gm−1 at low voltage VSS.

When the first variable mode part 210 of a second dummy stage SRCd2 receives the high voltage VON of the m-th gate signal Gm, the second dummy stage SRCd2 is driven so as to output a second dummy signal DD2 at high voltage VON.

When VON is applied to the second variable mode part 250 of the m-th stage SRCm, the m-th stage SRCm outputs the m gate signal Gm at low voltage VSS.

When the second variable mode part 250 of the second dummy stage SRCd2 receives the vertical start signal STV of a next frame, the second dummy stage SRCd2 outputs the second dummy signal DD2 at low voltage VSS. The second dummy signal DD2 is not applied to the gate line, and is used as a control signal discharging the m-th gate signal Gm to the low voltage VSS.

Referring to FIG. 3, FIG. 4 and FIG. 6B, the first clock terminal CT1 of the n-th stage SRCn receives the first clock signal CK1 and the second clock terminal CT2 of the n-th stage SRCn receives the second clock signal CK2. The voltage terminal VT of the n-th stage SRCn receives the low voltage VSS. The first and second clock signals CK1 and CK2 are different from each other, and have a duty ratio DT which is about 50% or less.

To initiate forward direction mode, the first direction terminal DT1 receives a first direction signal VD1 that is the high voltage VON, and the second direction terminal DT2 receives a second direction signal VD2 that is the low voltage VSS. Thus, the first electrode part EP1 of the first variable mode part 210 receives the high voltage VON and the first electrode part EP1 of the second variable mode part 250 receives the low voltage VSS.

In an (n−1)-th period Tn−1, the control part CP of the first variable mode part 210 receives a (n−1)-th gate signal Gn−1 that is at high voltage VON, and the second and third TFTs TFT2 and TFT3 of the first variable mode part 210 are turned on in response. This applies the first direction signal VD1 of the high voltage VON to the node Q. This high voltage VON applied to the node Q charges the charging part 220. However, the low voltage VSS synchronized with the first clock signal CK1 is applied to the node N.

In an n-th period Tn, when the pull-up part 230 receives first clock signal CK1 at high voltage VON, the pull-up part 230 is bootstrapped. A voltage applied to the node Q (which is connected to the control part of the pull-up part 230) is boosted up to boosting voltage VBT. For example, the node Q is at high voltage VON in (n−1)-th period Tn−1, and at boosting voltage VBT in the n-th period Tn. During the n-th period Tn, the pull-up part 230 also outputs the high voltage VON of the first clock signal CK1 as the high voltage VON of the n-th gate signal Gn. While the pull-up part 230 outputs the n-th gate signal Gn having the high voltage VON, the eighth and thirteenth transistors TR8 and TR13 are turned on in response to this high voltage VON, so that the node N is discharged to the low voltage VSS. In an (n+1)-th period Tn+1, the second variable mode part 250 receives high voltage VON from the (n+1)-th gate signal Gn+1. When part 250 includes variable element TRV of FIG. 4, the control part CP of the second variable mode part 250 receives this high voltage VON and the second variable mode part 250 is driven by only the second TFT TFT2, so that the second direction signal VD2, which is at low voltage VSS, is applied to the node Q. This discharges the boosting voltage VBT to the low voltage VSS.

After the (n+1)-th period Tn+1, the first holding part 281 discharges a voltage applied to the output node O to the low voltage VSS in response to the high voltage VON of the second clock signal CK2. Also, the second holding part 282 discharges a voltage applied to the node Q to the low voltage VSS in response to the high voltage VON of the first clock signal CK1. In addition, the third holding part 283 discharges the voltage applied to the output node O to the low voltage VSS in response to the high voltage VON applied to the node N. That is, the first, second and third holding parts 281, 282 and 283 hold the n-th gate signal Gn at the low voltage VSS during that remaining period of the frame which excludes the n-th period Tn.

Figure 7A:
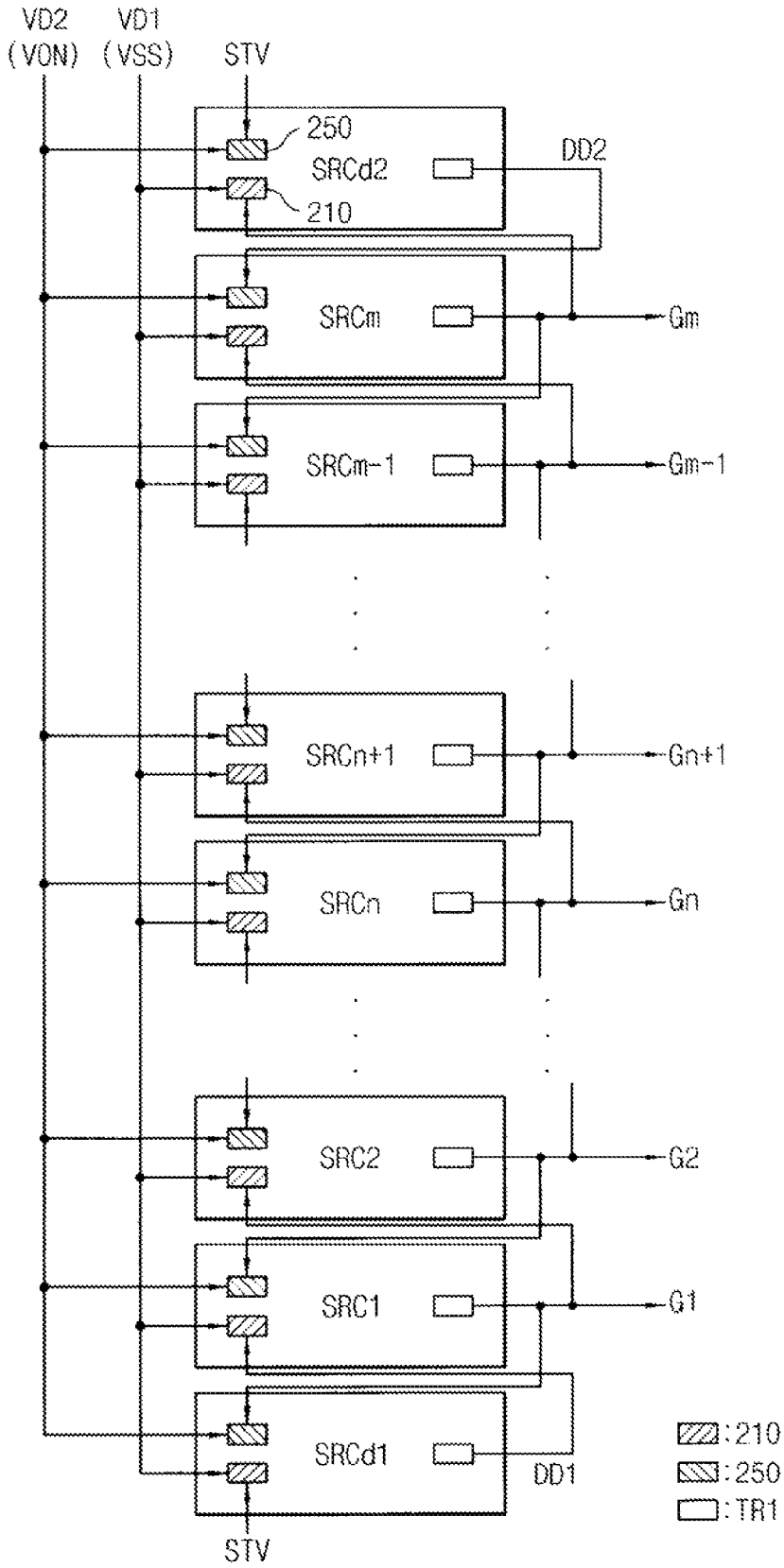
FIG. 7A is a block diagram illustrating an operation in which the gate driving circuit of FIG. 2 is driven in a reverse direction.
Figure 7B:
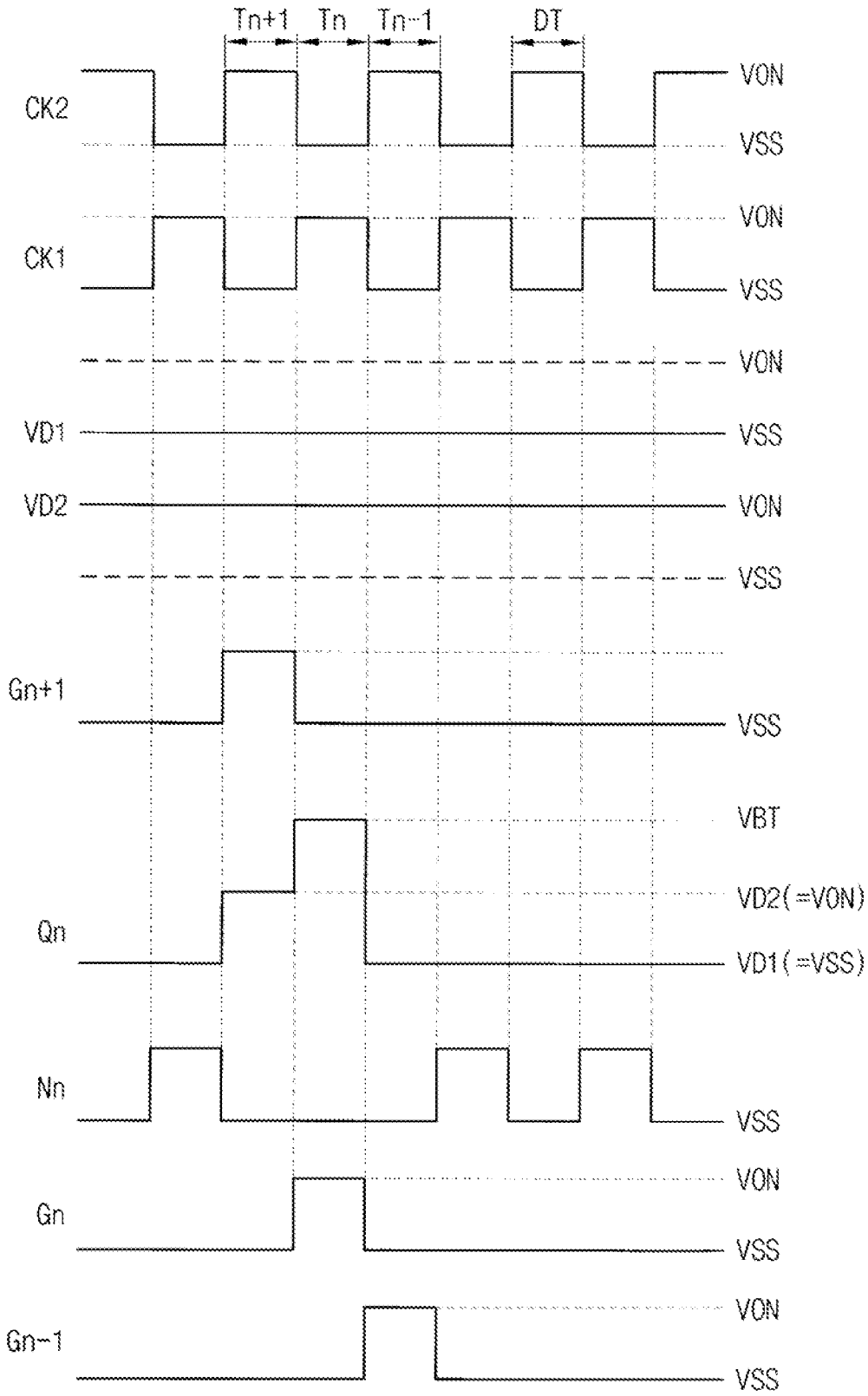
FIG. 7B is a waveform diagram illustrating input/output signals of the n-th stage of FIG. 7A.

FIG. 7A is a block diagram illustrating an operation in which the gate driving circuit of FIG. 2 is driven in a reverse direction. FIG. 7B is a waveform diagram illustrating input/output signals for the n-th stage of FIG. 7A.

Referring to FIG. 4 and FIG. 7A, the gate driving circuit 200 receives the vertical start signal STV, the first clock signal CK1, the second clock signal CK2, the first direction signal VD1 (VSS), the second direction signal VD2 (VON) and the low voltage VSS.

The vertical start signal STV is applied to a first stage, that is, the first dummy stage SRCd1 and a last stage, that is, the second dummy stage SRCd2. The first clock signal CK1, the second clock signal CK2, the first direction signal VD1 (VSS), the second direction signal VD2 (VON) and the low voltage VSS are applied to all stages of the gate driving circuit 200. The first variable mode part 210 of each of the stages is driven in the discharging mode when it receives low voltage VSS from the first direction signal VD1. The second variable mode part 250 of each of the stages is driven in the charging mode by receiving high voltage VON from the second direction signal VD2.

When the second variable mode part 250 of the second dummy stage SRCd2 receives the vertical start signal STV, the second dummy stage SRCd2 is driven so as to output a second dummy signal DD2 at high voltage VON. The second dummy signal DD2 is applied to the second variable mode part 250 of the m-th stage SRCm. The second dummy signal DD2 is not applied to the gate line, but is instead used as a start signal of the m-th stage SRCm.

When the second variable mode part 250 of the m-th stage SRCm receives high voltage VON from the second dummy signal DD2, the m-th stage SRCm is driven so as to output an m-th gate signal Gm at high voltage VON. The gate signal Gm is applied to the first variable mode part 210 of the second dummy stage SRCd2, which then outputs the second dummy signal DD2 at low voltage VSS.

When the second variable mode part 250 of an (m−1)-th stage SRCm−1 receives the high voltage VON of the m-th gate signal Gm, SRCm−1 is driven so as to output an (m−1)-th gate signal Gm−1 at high voltage VON. When the gate signal Gm−1 applies VON to the first variable mode part 210 of the m-th stage SRCm, SRCm outputs the m-th gate signal Gm at low voltage VSS. When the high voltage VON of a (m−2)-th gate signal Gm−2 is applied to the first variable mode part 210 of the (m−1) stage SRCm−1, SRCm−1 outputs the (m−1)-th gate signal Gm−1 at low voltage VSS.

When the second variable mode part 250 of an (n+1)-th stage SRCn+1 receives the high voltage VON of an (n+2)-th gate signal Gn+2, SRCn+1 is driven so as to output the (n+1)-th gate signal Gn+1 at high voltage VON.

When the second variable mode part 250 of an n-th stage SRCn receives the high voltage VON of the (n+1)-th gate signal Gn+1, SRCn is driven so as to output the n-th gate signal Gn at high voltage VON. When the n-th gate signal Gn applies VON to the first variable mode part 210 of the (n+1)-th stage SRCn+1, the (n+1)-th stage SRCn+1 outputs the (n+1)-th gate signal Gn+1 at low voltage VSS.

When the second variable mode part 250 of a second stage SRC2 receives the high voltage VON of a third gate signal G3, the second stage SRC2 is driven so as to output the second gate signal G2 at high voltage VON.

When the second variable mode part 250 of a first stage SRC1 receives the high voltage VON of the second gate signal G2, the first stage SRC1 is driven so as to output the first gate signal G1 at high voltage VON. When the first gate signal G1 applies VON to the first variable mode part 210 of the second stage SRC2, the second stage SRC2 outputs low voltage VSS from its second signal G2.

When the second variable mode part 250 of a first dummy stage SRCd1 receives the high voltage VON from the first gate signal G1, the first dummy stage SRCd1 is driven so as to output high voltage VON as its first dummy signal DD1. When the first dummy signal DD1 applies VON to the first variable mode part 210 of the first stage SRC1, the first stage SRC1 outputs low voltage VSS from its first gate signal G1.

When the first variable mode part 210 of the first dummy stage SRCd1 receives the vertical start signal STV of a next frame, the first dummy stage SRCd1 outputs low voltage VSS from its first dummy signal DD1. The first dummy signal DD1 is not applied to the gate line, and is used as a control signal discharging the first gate signal G1 to the low voltage VSS.

Referring to FIG. 3, FIG. 4 and FIG. 7B, the first clock terminal CT1 of the n-th stage SRCn receives the first clock signal CK1 and the second clock terminal CT2 of the n-th stage SRCn receives the second clock signal CK2. The voltage terminal VT of the n-th stage SRCn receives the low voltage VSS.

To enter reverse direction mode, the first direction terminal DT1 receives low voltage VSS, and the second direction terminal DT2 receives high voltage VON. Thus, the first electrode part EP 1 of the second variable mode part 250 receives high voltage VON and the first electrode part EP1 of the first variable mode part 210 receives low voltage VSS.

In an (n+1)-th period Tn+1, the control part CP of the second variable mode part 250 receives high voltage VON from the (n+1)-th gate signal Gn+1. This turns on the second and third TFTs TFT2 and TFT3 of the second variable mode part 250, so that VON is applied to the node Q. This in turn charges the charging part 220. However, the low voltage VSS, which is synchronized with the first clock signal CK1, is applied to the node N.

In an n-th period Tn, when the pull-up part 230 receives a first clock signal CK1 that is at the high voltage VON, the pull-up part 230 is bootstrapped. A voltage applied to the node Q is boosted up to boosting voltage VBT. For example, the node Q is at high voltage VON in the (n+1)-th period Tn+1, and is at boosting voltage VBT in the n-th period Tn. In the n-th period Tn, where boosting voltage VBT is applied to the node Q, the pull-up part 230 outputs the high voltage VON of the first clock signal CK1 as the gate signal Gn. While the pull-up part 230 outputs the n-th gate signal Gn having the high voltage VON, the eighth and thirteenth transistors TR8 and TR13 are turned on, so that the node N is discharged to the low voltage VSS.

In an (n−1)-th period Tn−1, when the first variable mode part 210 receives the high voltage VON from the (n−1)-th gate signal Gn−1, the control part CP of the first variable mode part 210 receives VON and the first variable mode part 210 is driven by only the second TFT TFT2, so that the first direction signal VD1 having the low voltage VSS is applied to the node Q. This results in the first variable mode part 210 discharging the boosting voltage VBT to the low voltage VSS.

After the (n−1)-th period Tn−1, the first holding part 281 discharges output node O to low voltage VSS in response to the high voltage VON of the second clock signal CK2. The second holding part 282 discharges node Q to low voltage VSS in response to the high voltage VON of the first clock signal CK1. In addition, the third holding part 283 discharges output node O to low voltage VSS in response to the high voltage VON applied to the node N. The first, second and third holding parts 281, 282 and 283 thus hold the n-th gate signal Gn to the low voltage VSS during that period of the frame which excludes the n-th period Tn.

According to the present invention, the operation mode of the first and second variable mode parts is changed by the level of the first and second direction signals, so that the gate driving circuit may be selectively driven in the forward direction and the reverse direction.

The foregoing is illustrative of the present invention and is not to be construed as limiting thereof. Although a few example embodiments of the present invention have been described, those skilled in the art will readily appreciate that many modifications are possible in the example embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific example embodiments disclosed, and that modifications to the disclosed example embodiments, as well as other example embodiments, are intended to be included within the scope of the appended claims. The present invention is defined by the following claims, with equivalents of the claims to be included therein.

What is claimed is:

1. A gate driving circuit including a plurality of stages cascade-connected to each other and each outputting a respective one of a plurality of gate signals, an n-th stage (wherein, n is an integer) of the stages comprising:

a pull-up part outputting a first voltage of a first clock signal as an output signal of the n-th stage in response to an input voltage;

a first variable mode part applying a first direction signal to a control part of the pull-up part in response to a vertical start signal or an output signal of a previous one of the stages; and a second variable mode part applying a second direction signal to the control part of the pull-up part in response to the vertical start signal or an output signal of a next one of the stages, the second direction signal being different from the first direction signal, wherein at least one of the first and second variable mode parts includes a variable element, and the variable element comprises:

a first thin-film transistor (TFT) turned on in response to a first level voltage of the first or second direction signal;

a second TFT applying the first or second direction signal to the control part of the pull-up part in response to the output signal of a previous one of the stages or the output signal of a next one of the stages; and a third TFT connected to the second TFT through the first TFT, and applying the first or second direction signal to the control part of the pull-up part in response to the output signal of a previous one of the stages or the output signal of a next one of the stages;

wherein when the first direction signal is applied to the first variable mode part, the second direction signal is applied to the second variable mode part, the first direction signal has the first level voltage, and the second direction signal has a second level voltage that is lower than the first level voltage, the n stages are driven in a first direction; and wherein when the second direction signal is applied to the first variable mode part, the first direction signal is applied to the second variable mode part, the first direction signal has the first level voltage, and the second direction signal has the second level voltage, the n stages are driven in a second direction opposite to the first direction.

2. The gate driving circuit of claim 1 wherein, when the first direction signal has the first level voltage and the second direction signal has the second level voltage has a voltage different than the first level voltage, the first variable mode part applies the first direction signal to the control part of the pull-up part and the pull-up part outputs the output signal of the n-th stage based on the first direction signal.

3. The gate driving circuit of claim 2, wherein the second variable mode part discharges a voltage applied to the control part of the pull-up part in response to the output signal of one of the previous stages or the output signal of one of the next stages.

4. The gate driving circuit of claim 3, wherein each of the first and second variable mode parts includes one of the variable elements, and wherein a channel length-to-channel width ratio of the variable element in the first variable mode part is greater than a channel length-to-channel width ratio of the variable element in the second variable mode part.

5. The gate driving circuit of claim 1 wherein, when the first direction signal has the second level voltage and the second direction signal has the first level voltage, the second variable mode part applies the second direction signal to the control part of the pull-up part, and the pull-up part outputs the output signal of the n-th stage based on the second direction signal.

6. The gate driving circuit of claim 5, wherein the first variable mode part discharges a voltage applied to the control part of the pull-up part in response to the output signal of one of the previous stages or the output signal of one of the next stages.

7. The gate driving circuit of claim 6, wherein each of the first and second variable mode parts includes one of the variable elements, and wherein a channel length-to-channel width ratio of the variable element in the second variable mode part is greater than a channel length-to-channel width ratio of the variable element in the first variable mode part.

8. The gate driving circuit of claim 1, further comprising:

a first holding part discharging a voltage applied to an output part of the pull-up part to a second level voltage in response to the first level voltage of a second clock signal; and a second holding part discharging a voltage applied to a control part of the pull-up part to a second level voltage at least partially in response to the first level voltage of the first clock signal.

9. The gate driving circuit of claim 1, further comprising:

a switching part outputting a signal synchronized with the first clock signal; and a third holding part discharging a voltage applied to an output part of the pull-up part to the second level voltage in response to the first level voltage outputted from the switching part.

10. A display apparatus comprising:

a display panel including a display area and a peripheral area surrounding the display area, the display area for displaying an image, gate and source lines being formed at least partially in the display area;

a gate driving circuit integrated in the peripheral area and including a plurality of stages outputting gate signals to their respective gate lines; and a main driving circuit providing a first direction signal and a second direction signal to the gate driving circuit according to a direction of an image to be displayed on the display panel, the second direction signal being different from the first direction signal, an n-th stage (wherein n is an integer) of the stages comprising:

a pull-up part outputting a first voltage of a first clock signal as an output signal of the n-th stage in response to an input voltage;

a first variable mode part applying a first direction signal to a control part of the pull-up part in response to a vertical start signal or an output signal of a previous one of the stages; and a second variable mode part applying a second direction signal to the control part of the pull-up part in response to the vertical start signal or an output signal of a next one of the stages, wherein at least one of the first and second variable mode parts includes a variable element, and the variable element comprises:

a first TFT turned on in response to a first level voltage of the first or second direction signal;

a second TFT applying the first or second direction signal to the control part of the pull-up part in response to the output signal of a previous one of the stages or the output signal of a next one of the stages; and a third TFT connected to the second TFT through the first TFT, and applying the first or second direction signal to the control part of the pull-up part in response to the output signal of a previous one of the stages or the output signal of a next one of the stages;

wherein when the first direction signal is applied to the first variable mode part, the second direction signal is applied to the second variable mode part, the first direction signal has the first level voltage, and the second direction signal has a second level voltage that is lower than the first level voltage, the n stages are driven in a first direction; and wherein when the second direction signal is applied to the first variable mode part, the first direction signal is applied to the second variable mode part, the first direction signal has the first level voltage, and the second direction signal has the second level voltage, the n stages are driven in a second direction opposite to the first direction.

11. The display apparatus of claim 10, wherein, when the first direction signal has the first level voltage and the second direction signal has the second level voltage, the first variable mode part applies the first direction signal to the control part of the pull-up part and the pull-up part outputs the output signal of the n-th stage based on the first direction signal.

12. The display apparatus of claim 11, wherein the second variable mode part discharges a voltage applied to the control part of the pull-up part in response to the output signal of one of the previous stages or the output signal of one of the next stages.

13. The display apparatus of claim 12, wherein each of the first and second variable mode parts includes one of the variable elements, and wherein a channel length-to-channel width ratio of the variable element in the first variable mode part is greater than a channel length-to-channel width ratio of the variable element in the second variable mode part.

14. The display apparatus of claim 10 wherein, when the first direction signal has the second level voltage and the second direction signal has the first level voltage, the second variable mode part applies the second direction signal to the control part of the pull-up part, and the pull-up part outputs the output signal of the n-th stage based on the second direction signal.

15. The display apparatus of claim 14, wherein the first variable mode part discharges a voltage applied to the control part of the pull-up part in response to the output signal of one of the previous stages or the output signal of one of the next stages.

16. The display apparatus of claim 15, wherein each of the first and second variable mode parts includes one of the variable elements, and wherein a channel length-to-channel width ratio of the variable element in the second variable mode part is greater than a channel length-to-channel width ratio of the variable element in the first variable mode part.

17. The display apparatus of claim 10, further comprising:

a first holding part discharging a voltage applied to an output part of the pull-up part to a second level voltage in response to the first level voltage of a second clock signal; and a second holding part discharging a voltage applied to a control part of the pull-up part to a second level voltage at least partially in response to the first level voltage of the first clock signal.

18. The display apparatus of claim 10, further comprising:

a switching part outputting a signal synchronized with the first clock signal; and a third holding part discharging a voltage applied to an output part of the pull-up part to the second level voltage in response to the first level voltage outputted from the switching part.

* * * * *